US005729237A

United States Patent [19]

Webb

[11] Patent Number: 5,729,237

[45] Date of Patent: Mar. 17, 1998

[54] PROBE FED LAYERED ANTENNA

[75] Inventor: Roger Charles Webb, Paignton, United Kingdom

[73] Assignee: Northern Telecom Limited, Montreal, Canada

[21] Appl. No.: 373,007

[22] Filed: Jan. 17, 1995

[30] Foreign Application Priority Data

Feb. 10, 1994 [GB] United Kingdom ..... 9402550

[51] Int. Cl.[6] ..... H01Q 1/38; H01Q 13/10

[52] U.S. Cl. ..... 343/700 MS; 343/770; 343/767

[58] Field of Search ..... 343/700 MS, 767, 343/770, 771, 768, 846, 848; H01Q 1/38, 13/10

[56] References Cited

U.S. PATENT DOCUMENTS

| | | | |
|---|---|---|---|
| 4,853,704 | 8/1989 | Diaz et al. | 343/767 |
| 4,899,162 | 2/1990 | Bayetto et al. | 343/700 MS |
| 5,185,611 | 2/1993 | Bitter, Jr. | 343/702 |
| 5,268,701 | 12/1993 | Smith | 343/767 |
| 5,414,434 | 5/1995 | Conant et al. | 343/700 MS |

FOREIGN PATENT DOCUMENTS

| | | | |
|---|---|---|---|
| 147488 | 7/1952 | Australia | 343/770 |
| 672034 | 5/1952 | United Kingdom | 343/767 |
| 1398262 | 7/1972 | United Kingdom . | |
| 2248344 | 9/1990 | United Kingdom . | |

*Primary Examiner*—Hoanganh T. Le
*Attorney, Agent, or Firm*—Lee, Mann, Smith, McWilliams, Sweeney & Ohlson

[57] ABSTRACT

A layered antenna having a linear array of radiating elements 11 is disclosed. Each radiating element comprises an aperture with one or more probes 16,18 which extend into the area defined by the aperture. The elements are deformed about an axis parallel with a longitudinal axis of the linear array to provide beam control. A method of manufacture is also disclosed.

21 Claims, 2 Drawing Sheets

PROBE FED LAYERED ANTENNA

BACKGROUND TO THE INVENTION

This invention relates to a microstrip or triplate antenna having a linear array of radiating apertures or elements.

A form of triplate antenna comprises a pair of closely spaced correspondingly apertured ground planes with an interposed printed film circuit, electrically isolated from the ground planes, the film circuit providing excitation elements or probes within the areas of the apertures, to form dipoles, and a feed network for the dipoles. In an array antenna a plurality of such aperture/element configurations are spaced at regular intervals colinearly in the overall triplate structure. The antenna may further comprise an unapertured ground plane placed parallel with and spaced from one of the apertured ground planes to form a rear reflector for the antenna. This antenna construction lends itself to a cheap yet effective construction for a linear array antenna such as may be utilised for a cellular telephone base station. Such an antenna is disclosed in our copending patent application U.S. Ser. No. 07/969,750.

A problem with such linear array antennas is the need to control the beamwidth of the antenna, especially where a plurality of like linear array antennas are juxtaposed with regular angular orientation around a common mounting means to provide horizontal radiation coverage for a cell in a cellular base station. British patent GB 1398262 (EMI) discloses an array of aerial elements formed on a planar substrate. Corrugated metallic sections extending at an angle rearwardly of the planar substrate are provided. These corrugated sections control the radiation pattern in a plane normal to the array length, as best seen in FIG. 5 of this EMI document. However such a design is not compact and suffers from being a narrowband design which is difficult to scan and beam forming capabilities are limited. Furthermore fabrication is both complicated and expensive. In the case of layered antennas, careful design of the dimensions of the apertures and the elements coupled with the design of the electrical characteristics of the feed network for the elements can give a measure of control of beamwidth, but for some applications this is not sufficient.

SUMMARY OF THE INVENTION

According to the present invention there is provided a layered antenna having a linear array of radiating elements wherein each radiating element comprises an aperture with one or more probes which extend into the area defined by the aperture wherein the elements are deformed about an axis parallel with a longitudinal axis of the linear array. By shaping the antenna in such a fashion the beam shape can be controlled. If the axis determined by the shape is parallel with the arrangement of feed probes which extend into apertures of the feed elements, then the beam width in azimuth can reliably be controlled. In accordance with one embodiment the array of elements comprises two planar portions angled with respect to each other about the axis of deformation. Preferably the planar portions on either side of the deformation axis define an angle therebetween which is less than 180°. The planar portions can both be both flat.

In accordance with another aspect of the invention, the elements are deformed such that they have a uniform radius of curvature from the axis which axis can be behind the array.

An antenna in accordance with another aspect of the invention can comprise a single radiating element including an aperture with two coaxial probes which extend into the area defined by the aperture, wherein the element has a shape about an axis parallel with an axis defined by the probes, which access is non-planar such as to control the beamwidth.

A reflecting ground plane can be situated behind the array. Preferably, the reflecting ground plane is flat. The reflecting ground plane acts to increase forward gain of the antenna.

In accordance with a still further aspect of the invention, there is provided a method of manufacturing a layered antenna having a linear array of radiating apertures or elements wherein an initially flat triplate or microstrip structure is deformed about a longitudinal axis parallel with a longitudinal axis of the linear array of elements. The shaping can be effected by creasing the initially flat structure about an axis coincident with the longitudinal axis of the array or by curving the initially flat structure about a longitudinal axis parallel with and spaced from the longitudinal axis of the array.

There is also provided a method of manufacturing a layered antenna having a linear array of radiating apertures or elements, the antenna comprising a first apertured ground plane, a dielectric having a feed circuit printed thereon and a second ground plane, wherein the ground planes are shaped about an axis parallel with a longitudinal axis of the linear array prior to the placement of the dielectric film in a spaced apart relation therebetween, so that the shape of the antenna is non-planar such as to control the beamwidth of the array.

In accordance with a yet further aspect of the invention, there is also provided a method of receiving and transmitting radio signals in a cellular arrangement including an antenna element or array comprising a layered antenna including an element or a linear array of radiating elements wherein the elements are shaped about an axis parallel with a longitudinal axis of the linear array, which shape determines or helps to determine the beamwidth or shape of the radiation pattern of the antenna in azimuth.

There is also provided a method of receiving and transmitting signals by means of a layered antenna, wherein the method comprises the steps of distributing such signals between a plurality of radiating elements provided by such antenna, with opposed portions of the radiating elements being arranged about an axis common to such opposed portions, and distributing the signals between such opposed portions such that the angle determines or helps to determine the beamwidth or shape of the radiation pattern of the antenna in azimuth.

BRIEF DESCRIPTION OF THE DRAWINGS

Embodiments of the invention will now be described with reference to the accompanying drawings in which.

DETAILED DESCRIPTION OF A PREFERRED EMBODIMENT

Figure 1:
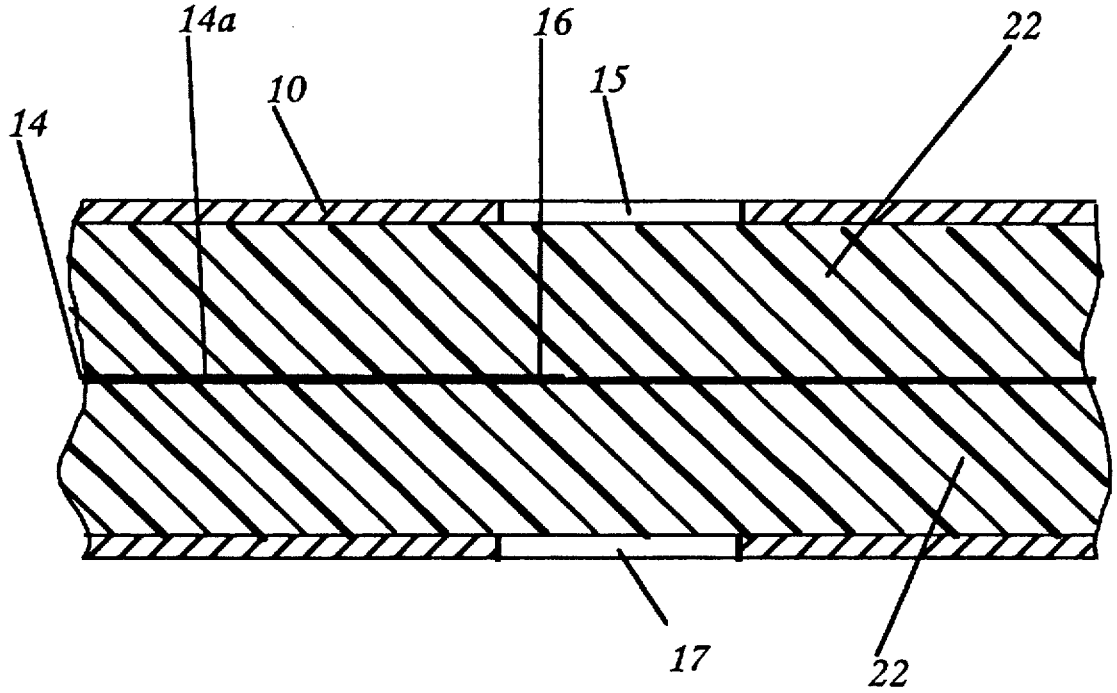
FIG. 1 is a side section view of part of a triplate antenna.
Figure 2:
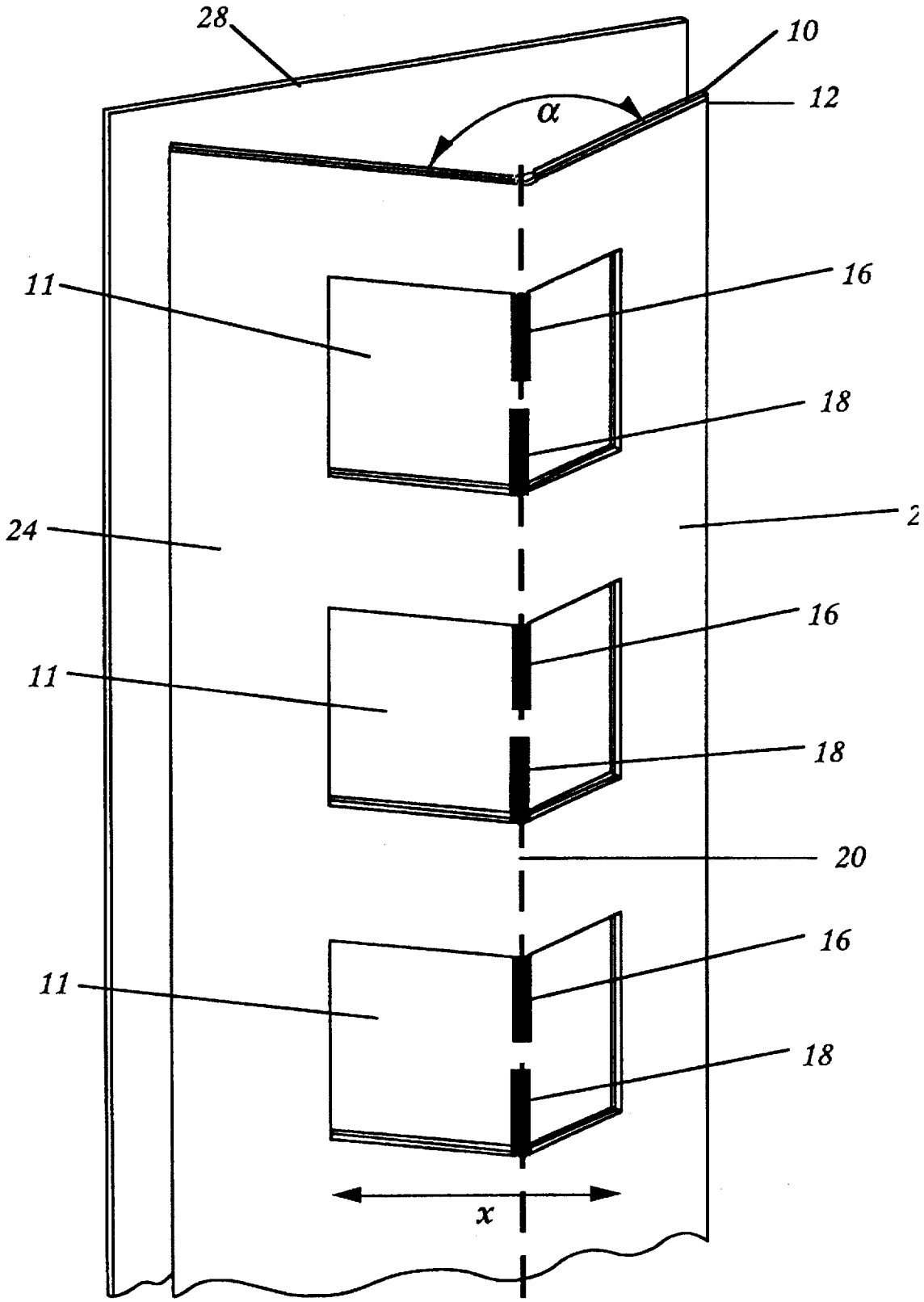
FIG. 2 is a perspective view of part of a linear array antenna.

The array antenna is constructed of a first apertured metal or ground plane 10, a second like metal or ground plane 12 and an interposed film circuit 14. Conveniently the planes 10 and 12 are thin metal sheets, e.g. of aluminium, which are initially flat, as shown in FIG. 1, and have substantially identical arrays of apertures 11, 13 formed therein by, e.g. press punching. In the embodiment shown the apertures are rectangular and formed as a single linear array. The film circuit 14 comprises a printed copper circuit pattern 14*a* on a thin dielectric film 14*b*. When sandwiched between the apertured ground planes part of the copper pattern 14*a* provides probes 16, 18 which extend into the areas of the apertures. The probes are electrically connected to a common feed point by the remainder of the printed circuit pattern which forms a feed conductor network in a conventional manner. In the embodiment shown the totality of probes in the array form a vertically polarised antenna when the linear array is positioned vertically. In a conventional triplate structure the film circuit is located between and spaced from the ground planes by sheets of foamed dielectric material 22. As stated above, initially the triplate structure is fabricated as a flat structure in the conventional manner. To achieve a predetermined beam shape in azimuth that is different from the beam shape afforded by the initial flat structure the structure is then deliberately deformed about an axis parallel with the linear array of apertures. In the example illustrated the triplate structure is creased along an axis 20 substantially colinear with the linear arrangement of probes 16, 18. The two flat portions 24, 26 of the structure on either side of the crease together define an angle θ. The beamwidth and shape of the radiation pattern of the antenna in azimuth are controlled by the angle θ. in conjunction with the transverse dimension x of the apertures. Depending on the required beam shape the angle θ. defined by the rear face of the triplate structure may be greater or lesser than 180°.

The antenna can also be fabricated using ground planes which have already been shaped e.g. aluminum ground planes that have been shaped about a desired axis by stamping, bending or otherwise. These pre-formed ground planes are then connected together with the antenna feed network placed between in a spaced apart relationship. If the feed network comprises a dielectric film or sheet with a circuit printed thereon, then dielectric spacers such as plastics foam sheets may be used to maintain the feed network correctly spaced from the ground planes. Alternatively, the ground planes could be formed of a moulded plastics material to which is applied a metallic coating.

In a preferred embodiment of the invention the linear apertured array is provided with a flat, unapertured ground plane 28, e.g. a metal plate, acting as a reflector situated at a distance behind the creased array.

In an alternative embodiment the linear apertured array may be curved rather than creased, the curvation being defined by the radial distance from an axis of rotation some distance behind, or in front of, the apertured array.

In use the antenna functions in a similar fashion to an ordinary antenna. When the antenna transmits, radio signals are fed to the antenna feed network 14*a* by, for example, coaxial wires from a base station controller, via diplexers and amplifiers. The feed network divides so that probes 16 and 18 radiate with the areas defined by the apertures 11, 13 whereby the angle θ defined between the planar portions 24 and 26 determines the azimuthal beamwidth. In the receive mode, the antenna also operates with an increased azimuthal beamwidth by virtue of the angle θ defined between the planar portions 24 and 26.

I claim:

1. A layered microstrip antenna having a linear array of radiating elements aligned in a spaced manner in the antenna, wherein each radiating element comprises an aperture having at least one probe extending into the area defined by the aperture, and wherein the elements have a shape about an axis parallel with a longitudinal axis of the linear array, which shape is non-planar and determines the beamwidth of the array.

2. An antenna according to claim 1, wherein the linear array of elements comprises two planar portions angled with respect to each other about said axis.

3. An antenna according to claim 2, wherein the planar portions are both flat.

4. An antenna according to claim 2, wherein the axis is a deformation axis, and the planar portions on either side of the deformation axis define an angle therebetween which angle is less than 180°.

5. An antenna according to claim 4, wherein the planar portions are both flat.

6. An antenna according to claim 4, wherein the elements have a shape such that they have a uniform radius of curvature from said axis.

7. An antenna according to claim 6, wherein said axis is behind the array.

8. An antenna according to claim 1, wherein a reflecting ground plane is situated behind the array.

9. A layered microstrip antenna having a radiating element comprising an aperture having at least one probe extending into the area defined by the aperture, wherein the element has a shape about an axis parallel with an axis defined by the probes, which shape is non-planar and determines the beamwidth of the antenna.

10. An antenna according to claim 9, wherein a reflecting ground plane is situated behind the radiating element.

11. A layered antenna having a linear array of radiating elements, comprising a first conductive ground plane, a first dielectric spacer, a dielectric film having a feed circuit printed thereon, a second dielectric spacer and a second conductive ground plane wherein each radiating element comprises an aperture in the first ground plane having one or more probes extending into the area defined by the aperture, and wherein the elements have a shape about an axis parallel with a longitudinal axis of the linear array, which shape is non-planar and determines the beamwidth of the array.

12. An antenna according to claim 11, wherein the linear array of elements comprises two planar portions angled with respect to each other about said axis.

13. An antenna according to claim 12, wherein the planar portions are both flat.

14. An antenna according to claim 12, wherein the planar portions on either side of the deformation axis define an angle therebetween which angle is less than 180°.

15. An antenna according to claim 14, wherein the planar portions are both flat.

16. An antenna according to claim 11, wherein the elements have a shape such that they have a uniform radius of curvature from said axis.

17. An antenna according to claim 16, wherein said axis is behind the array.

18. A method of manufacturing a layered antenna having a linear array of radiating elements, the antenna comprising a first apertured ground plane, a dielectric having a feed circuit printed thereon and a second apertured ground plane, wherein the ground planes are shaped about an axis parallel with a longitudinal axis of the linear array prior to the placement of the dielectric in a spaced apart relation therebetween so that the shape of the antenna is non-planar and determines the beamwidth of the array.

19. A method of manufacturing a layered antenna having a linear array of radiating elements, the antenna comprising a first apertured ground plane, a dielectric having a feed circuit printed thereon and a second ground plane, with the dielectric being placed in a spaced apart relation to the ground planes, wherein an initially flat triplate structure is shaped about a longitudinal axis parallel with a longitudinal axis of the linear array of radiating elements so that the shape of the antenna is non-planar and determines the beamwidth of the array.

20. A method of receiving and transmitting signals by means of a layered microstrip antenna, the method comprising the steps of distributing such signals between a plurality of radiating elements provided by such antenna with the radiating elements being aligned in a spaced manner in the antenna, with opposed portions of the radiating elements being arranged about an axis common to such opposed portions, and distributing the signals between such opposed portions such that the angle determines or helps to determine the beamwidth or shape of the radiation pattern of the antenna in azimuth.

21. A method of manufacturing a layered antenna having a linear array of radiating elements, the antenna comprising a first apertured ground plane, a dielectric having a feed circuit printed thereon and a second ground plane, with the dielectric being placed in a spaced apart relation to the ground planes, wherein an initially flat microstrip structure is shaped about a longitudinal axis parallel with a longitudinal axis of the linear array of radiating elements so that the shape of the antenna is non-planar and determines the beamwidth of the array.

* * * * *